United States Patent [19]

Holbrook et al.

[11] 4,194,925

[45] Mar. 25, 1980

[54] METHOD AND APPARATUS FOR WASHING MIXING CONTAINERS

[75] Inventors: Fred D. Holbrook, Statesville; Perry Holbrook, Thomasville, both of N.C.

[73] Assignee: Columbia Machine, Inc., Vancouver, Wash.

[21] Appl. No.: 824,700

[22] Filed: Aug. 15, 1977

[51] Int. Cl.[2] ..... B08B 9/00

[52] U.S. Cl. ..... 134/24; 134/22 R; 134/99; 134/153; 366/40; 366/64

[58] Field of Search ..... 134/18, 22 R, 23, 33, 134/99, 135, 153; 366/40, 64, 65, 66, 67

[56] References Cited

U.S. PATENT DOCUMENTS

| | | | |
|---|---|---|---|
| 701,465 | 6/1902 | Cavin | 356/40 |
| 2,201,284 | 5/1940 | Bilde | 134/99 |
| 3,598,130 | 8/1971 | Nolte et al. | 134/99 |
| 3,833,417 | 9/1974 | Griparis | 134/18 |

*Primary Examiner*—Arthur D. Kellogg

*Attorney, Agent, or Firm*—Kolisch, Hartwell, Dickinson & Stuart

[57] ABSTRACT

A method and apparatus for washing a mixing container or tube includes a network of piping mounted within the tub. The piping is interconnected to a pumping system operable for delivering a washing fluid, such as a liquid, to the piping. The piping includes spray outlets which may be selectively directed toward walls and internal components of the tub for Washing residue therefrom. The washing liquid may be retained within the tub as a portion of the liquid required for a subsequent mixing operation.

8 Claims, 7 Drawing Figures

METHOD AND APPARATUS FOR WASHING MIXING CONTAINERS

BACKGROUND AND SUMMARY OF THE INVENTION

The present invention relates to mixers or containers having internal components operable for mixing material, and more particularly to a method and apparatus for dispensing a fluid into a container for washing residue material therefrom and supplying mixing fluid.

One example of material mixing is in the production of concrete blocks. A large container or tub having internal rotary mixing blades is positioned beneath separate hoppers supplying aggregate and cement. Proportional amounts of the aggregate and cement as well as a mixing fluid, such as water, are released into the tub and thoroughly mixed by the rotating blades. After completion of the mixing, a dump gate, disposed on a bottom portion of the tub, is opened for permitting the concrete mixture to flow therefrom into a block mold or the like.

However, it must realized that significant amounts of concrete residue remain on the mixing blades as well as on the walls of the tub. This condition can be aggravated even further in tubs having spiral blades connected to a rotatable shaft. Because of the blade configuration, concrete residue will tend to adhere to the blade surfaces. Additionally, corners of the tub and the shaft itself provide regions for collecting concrete residue.

It must be appreciated that large mixing tubs may be continuously operated during a working shift and considerable residue may build up. Presently, the practice appears to be that the tubs are cleaned at the end of a work week. As can be readily appreciated, the spiral blades, the shaft and its components, the walls and corners of the container all will include significant amounts of concrete residue. The concrete residue may have hardened thereby preventing it being washed readily from the blades and tub. In fact, it has been necessary for workmen to actually physically enter a tub and use various implements for chipping away concrete residue. Not only is such a procedure time consuming and wearisome, it is also potentially dangerous. For instance, inadvertent operation of the spiral blades can cause severe injuries.

Accordingly, it is general object of the present invention to provide apparatus for mounting adjacent a mixing container for directing a washing fluid, such as water, against mixing components such as mixing blades and interior wall faces of the container. To this end, the present invention contemplates s network of spray piping mounted within the container having a plurality of fluid dispensing or spray outlets for spraying liquid.

Another object of the present invention is to provide container washing apparatus in which adjustable tubes or extensions are connected to the outlets for selective positioning relative to the conduits so that spray may be directed for the most efficient washing. Advantageously, spray may be directed to selected portions of the mixing blades and components as well as corners of the interior walls to ensure that residue is washed therefrom.

Still another object of the present invention is to provide a pumping system interconnected to the piping network for automatic operation of a cleaning operation. A timing mechanism is provided in the pumping system which is operable for selectively permitting transport of liquid to the piping network and spray outlets.

Yet a further object of the present invention is to provide a method for washing a mixing container in which washing liquid is retained in the container to provide at least a portion of the liquid required for mixing a subsequent batch of material.

These and additional objects and advantages of the present invention will be more readily understood from a consideration of the drawings and the following detailed description of the preferred embodiment.

DETAILED DESCRIPTION OF THE PREFERRED EMBODIMENT

Figure 1:
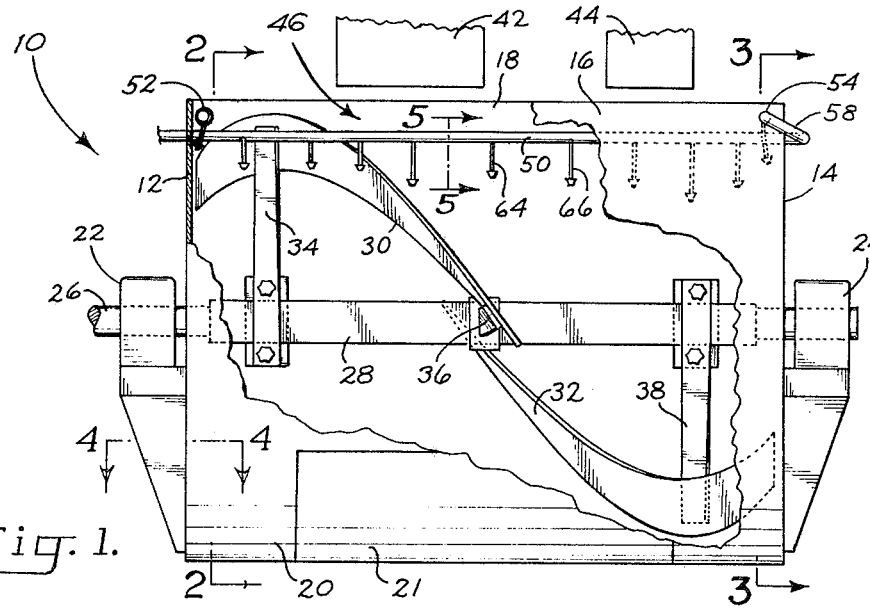
FIG. 1 is front elevation view, partially broken away, of a mixing container including portions of spray piping of a washing apparatus according to the present invention.
Figure 2:
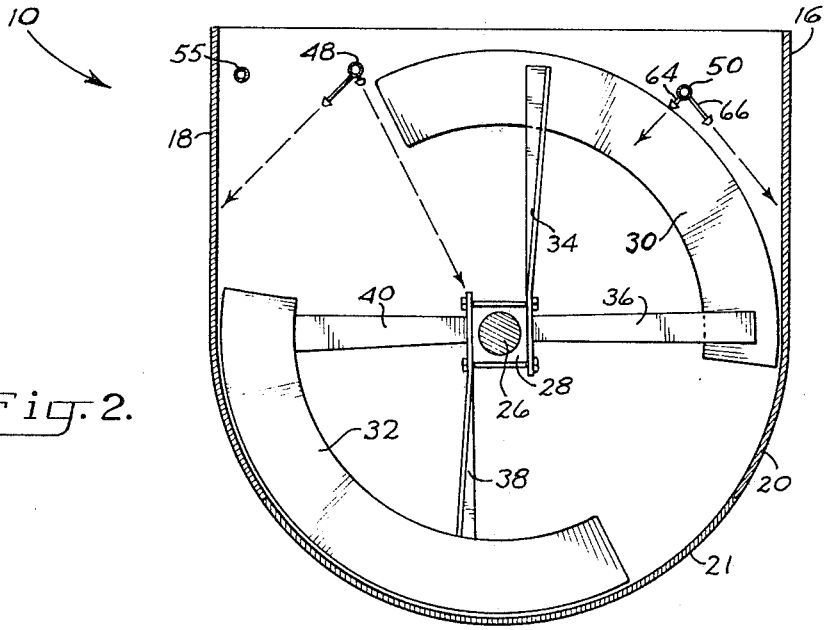
FIG. 2 is a side elevation view taken along line 2—2 of FIG. 1.
Figure 3:
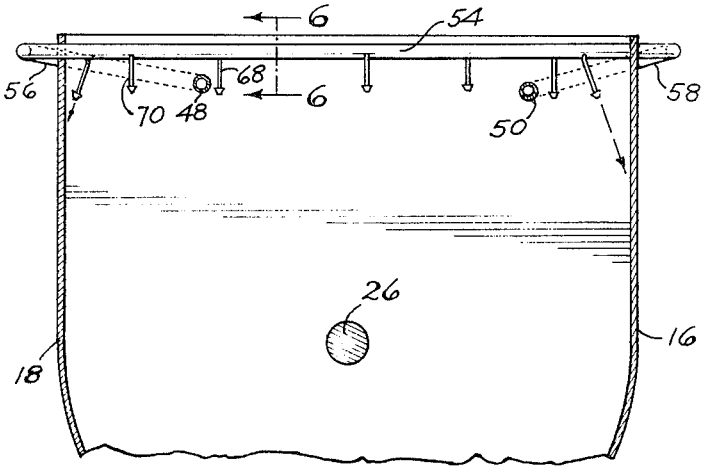
FIG. 3 is a side elevation view, partially broken away, taken along lines 3—3 of FIG. 1.

As stated above, the present invention is directed to a method and apparatus for washing a mixing container and its internal mixing components and also supplying mixing liquid. For instance, as shown in FIGS. 1-3, and with attention directed principally to FIG. 1, a conventional mixing container or tub is generally indicated at 10. Tub 10 is constructed with side walls 12, 14 and front and rear walls 16, 18 respectively. Each of the walls extends into a curved or rounded bottom portion indicated at 20. Bottom portion 20 is provided with a door or dump gate 21 which is swingable between open and closed positions.

Suitable bearings 22, 24 are mounted on respective supports adjacent walls 12, 14 respectively. Mounted in the bearings is an elongate shaft 26 which includes a shaft portion 28 having a rectangular or square cross-section. A suitable motor (not shown) is provided for rotating shaft 26 and shaft portion 28. Shaft portion 28 is disposed generally centrally within tub 10 and provides flat surfaces for mounting mixing components such as spiral-shaped mixing blades 30, 32.

Specifically, mixing blade 30 is secured to a pair of outwardly extending arms 34, 36 which are suitably mounted by bolts to shaft portion 28. Similarly, mixing blade 32 is interconnected to shaft portion 28 by means of arms 38, 40. Rounding out a general description of tub 10, it can be seen that the tub is positioned beneath a pair of hopper chutes 42, 44. Only portions of the chutes are illustrated. In the mixing of material to produce concrete, chute 42 will appropriately extend upwardly to an aggregate hopper while chute 44 will extend upwardly to a cement hopper. Thus, it can be seen that upon introduction of aggregate and cement accompanied by rotation of shaft 26, mixing blades 30, 32 will comingle the aggregate and cement for proper mixing. Water is also introduced to liquify the mixture.

After adequate mixing has been completed, dump gate 21 is swung downwardly in order to permit dumping of the concrete. After the concrete has been removed, it can be appreciated that concrete residue will adhere to walls 12, 14 and 16, 18, especially in the wall corners. In addition, residue will adhere to mixing blades 30, 32 as well as shaft portion 28 and the arms which interconnect the shaft portion to the mixing blades. It has been found that residue will particularly build up on outer surfaces of the mixing blades.

Washing of the concrete residue from the tub and its internal mixing components is accomplished by an apparatus according to the present invention, generally indicated at 45. A fluid dispensing means mounted adjacent the tub is operable for selectively directing fluid against the mixing components and internal wall faces of the tub. Specifically, as shown in FIGS. 1–3 and 7, a fluid dispensing means is generally indicated at 46 and includes a network of spray piping including conduits 48, 50, 52 and 54. A separate, tub filler pipe is shown at 55. Conduits 48, 50 extend in a direction parallel to the longitudinal axis of shaft 26 and project outwardly through side walls 12, 14. As shown in FIGS. 2 and 3, conduits 48, 50 are positioned somewhat interiorly of walls 16, 18 but outside of the paths scribed by mixing blades 30, 32. Suitable brackets (not shown) may be provided as additional support for the conduits.

Conduits 52, 54 are mounted to extend though walls 16, 18 and are positioned transversely of tub 10 adjacent to walls 12, 14 respectively. Flexible conduits or hoses 56, 58 interconnect conduit 54 with conduits 48, 50 while hose 60 interconnects conduit 52 to conduit 48.

Figure 6:
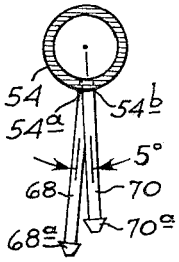
FIG. 6 is a cross-sectional view taken along lines 6—6 of FIG. 3.
Figure 7:
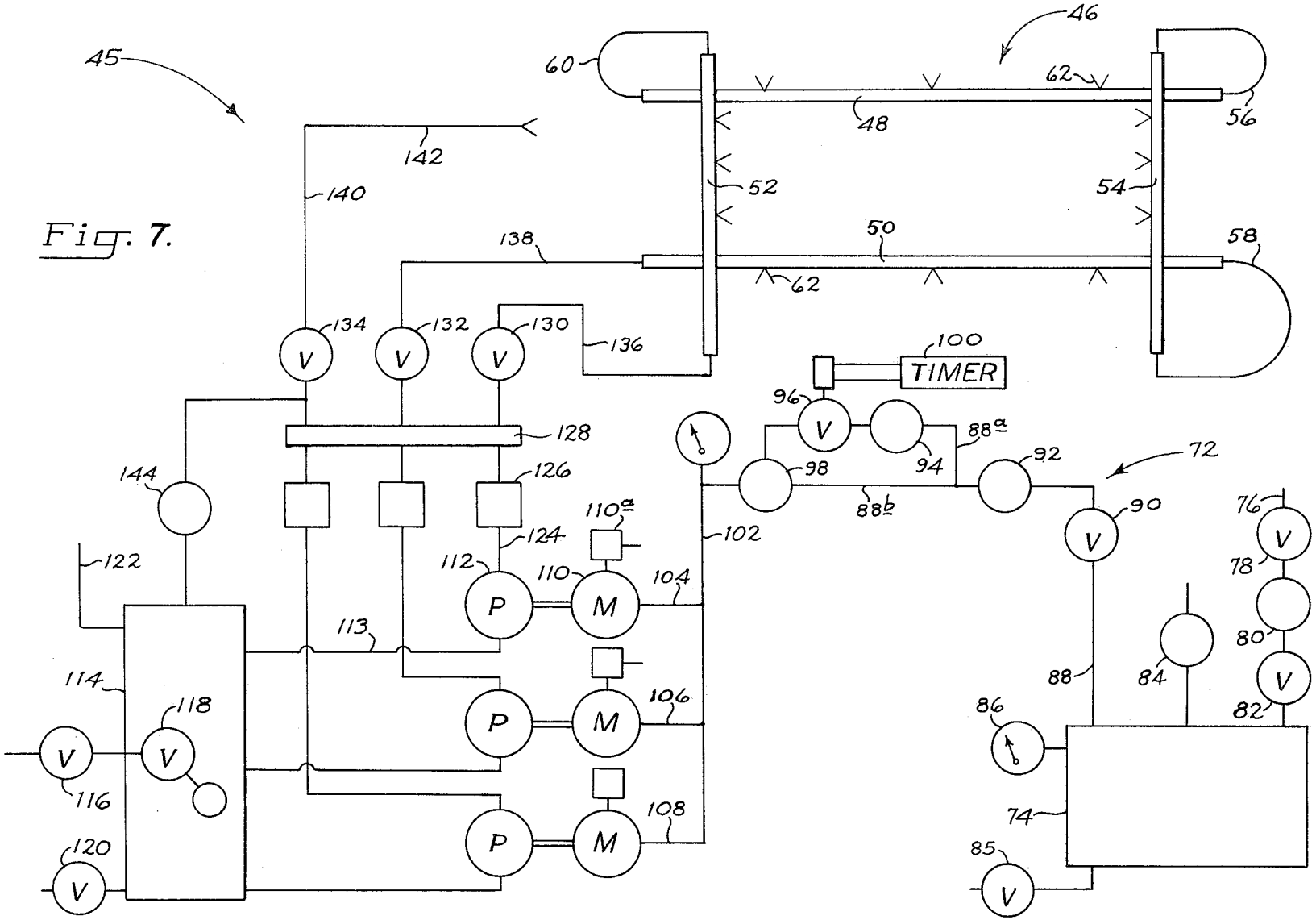
FIG. 7 is a schematic piping diagram illustrating a pumping system operable for selectively introducing liquid into the material mixing container for purposes of washing and providing mixing liquid.

As schematically shown in FIG. 7, each of the conduits is provided with a plurality of spray outlets for dispensing or spraying a fluid, such as water therefrom. As shown in FIG. 7, outlets are schematically indicated at 62 and are positioned at spaced-apart intervals along the length of a respective conduit. Actual location of the outlets is dependant upon washing action desired, and details of the outlets can be more fully appreciated from a consideration of FIGS. 5 and 6.

Figure 5:
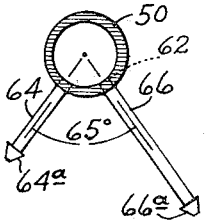
FIG. 5 is an enlarged cross-sectional view taken along lines 5—5 of FIG. 1.

As shown in FIG. 5, outlets 62 successively positioned along conduit 50 lie on radial lines which intersect the longitudinal axis of the conduit. Each outlet 62 may be disposed at an angle relative to another outlet. An angle of 65° is shown in FIG. 5, and suitably connected to each of the outlets and extending therefrom are smaller, individually adjustable tubular conduits or extensions indicated at 64, 66. Each of the extensions includes a spray nozzle such as nozzle **64*a* provided on extension 64. The extensions are shown positioned 65° apart, but are adjustable so that they may be selectively positioned relative to the conduits at other angles for directing spray in a predetermined direction. As shown in FIG. 2, extensions 64, 66** are positioned so that spray will be directed toward the walls and the mixing blades.

Similarly, conduits 52, 54 are provided with spray outlets and extensions for connection to spray nozzles. As shown in FIG. 6, conduit 54 is provided with outlets **54*a*, 54*b* which are positioned at an angle of approximately 5° apart along radial lines extending from the longitudinal axis of conduit 54. Suitably mounted to outlets 54*a*, 54*b* are extensions 68, 70 having nozzles 68*a*, 70*a* respectively. As shown in FIG. 3, the extensions are mounted at alternate positions along the length of conduit 54**. Further, the extensions are suitably mounted to the outlets so that they may be positioned for directing the spray nozzles in predetermined directions.

Returning to FIG. 7, details of a pump means, generally indicated at 72, for supplying fluid under pressure to dispensing means 46 will now be described. A compressed air tank is indicated at 74 and is suitably connected to a compressor (not shown). Leading from the compressor to tank 74 is an inlet pipe 76 provided with a manual cutoff valve 78, a one-way valve 80 and a needle valve 82. A pressure relief valve is indicated at 84, a drain valve at 85 and a pressure gauge at 86. Extending from the outlet of tank 74 is a pipe 88 having a manual cutoff value 90. Pipe 88 extends through an air filter 92 and into a parallel circuit having branches **88*a*, 88*b*. Branch 88*a* is provided with a pressure regulator 94 and a solenoid-operated valve 96. Another pressure regulator 98 is suitably provided and a timing mechanism or timer 100 is connected to solenoid valve 96 for selectively opening and closing the valve in a predetermined timed sequence. An outlet pipe 102 extends from pressue relief valve 98 and is connected to branches 104, 106 and 108**.

Each of branches 104, 106 and 108 is suitably connected to an air-driven motor such as motor 110 shown interconnected to branch 104. A muffler is indicated at **110*a*. Further, each of the motors is interconnected to a fluid pump mans such as pump 112 operable for being driven by motor 110**.

Each of the pumps is suitably interconnected to a fluid supply source such as water tank 114. A gate valve for filling the tank is indicated at 116 and a float at 118. A low water cutoff valve is shown at 120 and a vent as 122. Thus, it can be seen that pump 112 includes an inlet pipe 113 connected to tank 114 and an outlet pipe 124 including a strainer 126 connected to a header 128. Similarly, the other pumps have their inlet pipes connected to tank 114 and their outlet pipes communicating with header 128.

Header 128 includes outlets suitably connected to manually operable ball valves 130, 132 and 134. Valve 130 is provided with outlet piping 136 extending into one end of conduit 52. Similarly, valve 132 is provided with outlet piping 138 extending into one end of conduit 50. Valve 134 includes an outlet pipe 140 which is suitably connected to a manually positionable spraying mechanism generally indicated at 142. A pressure relief valve is indicated at 144.

From the above, it can be appreciated that compressed air from tank 74 may be supplied to the air motors by means of selective operation of timer 100. The air motors are operable for driving their respective pumps and supplying liquid to fluid dispensing means 46 as required. Valves 130, 132 and 134 are manually operable for providing desired amounts of liquid to fluid dispensing means 46 or to spraying mechanism 142.

Operation

Operation of apparatus 45 for purposes of washing and providing mixing fluid in a mixing sequence will now be described. Initially, the assumption will be made that a batch of concrete has been emptied or dumped from tub 10 and the interior faces of the walls and the mixing components are coated with concrete residue. With reference directed to FIGS. 1 and 7, it can be seen that valves 130 and 132 may be opened while valve 134 is closed. With timer 100 sequenced to open solenoid valve 96, comprssed air will be directed to the air driven motors for driving the pumps such as pump 112. Liquid will thereby be pumped into fluid dispensing means 46 for discharge outwardly through the spray outlets and nozzles provided in conduits 48, 50, 52 and 54.

Figure 4:
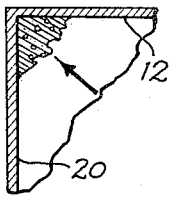
FIG. 4 is a view, partially broken away, illustrating a corner of the mixing container.

Extensions 64, 66, etc. are positioned in a desired direction so that spray will issue onto the walls and spiral mixing blades 30, 32 as well as onto shaft portion 28. Other extensions may be positioned for washing residue from arms 34, 36 and 38, 40. Additionally, it can be appreciated from a consideration of FIG. 4 that extensions 68, 70 may be directed toward wall corners for directing spray toward residue which may be built up therein. It should be appreciated that the washing operation as described may occur during rotation of the blades to ensure that complete cleaning takes place.

After a predetermined amount of washing liquid has been introduced into tub 10, timer 100 is automatically actuated to close solenoid valve 96 so that additional liquid is not sprayed. The washing liquid is retained within tub 10 and aggregate and concrete in predetermined amounts are introduced thereinto. Simultaneously, additional liquid may be added to tub 10 through filler pipe 55 until a preselected amount of liquid sufficient for mixing purposes is contained within the tub. The mixing operation is then completed, a batch released through opening of gate 21 and the entire operation is repeated.

If it is desired to provide washing by use of hand spraying mechanism 142, valves 130, 132 are closed and valve 134 is opened. The timer is then manually bypassed so that solenoid valve 96 is opened thereby operating the pump which is interconnected to hand spraying mechanism 142.

From the above description, it should be appreciated that the apparatus and method of the present invention provide several important advantages. Washing of the tub and the internal mixing components is automatic, and ensures that concrete residue will be removed prior to the formation of a subsequent batch thereby preventing hardening of the residue. Thus, it is not necessary to manually use chippers or hammers in order to remove hardened residue. Furthermore, rotation of the mixing components is enhanced due to the fact that no substantial weight build up of concrete residue occurs.

Additionally, it is to be appreciated that the present invention provides an apparatus and method for utilizing washing liquid as a portion of the mixing liquid for a subsequent batch. Thus, introduced fluid is directed into the tub for washing or cleaning purposes and is retained within the tub as a liquid for purposes of mixing.

Another important advantage of the present invention resides in the fact that conduits 48, 50, 52 and 54 are positioned generally in an internal peripheral loop so that the spray outlets may be selectively directed to completely wash the interior faces of the side and bottom walls as well as the internal mixing components. Because concrete residue can especially accumulate on shaft portion 28 and arms 34, 36 and 38, 40, it is important that the extensions may be directed toward these components. The present invention provides extensions which may be selectively positioned relative to an associated conduit for directing fluid in a predetermined direction. Accummulated concrete residue may thereby be completely washed from a surface and not permitted to harden.

While the present invention has been described with reference to the foregoing preferred embodiment, it will be readily appreciated that other changes and modifications can be made by way one having ordinary skill in the art.

It is claimed and desired to secure by Letters Patent:

1. Apparatus for washing a mixing container having side walls, an open top, a bottom portion provided with a dump gate and internal mixing components including a blade mounted on a power-driven rotatable shaft comprising:

fluid dispensing means including at least a pair of spaced-apart conduits mounted adjacent an upper portion of the container communicating with said pump means, said conduits including a plurality of spray outlets arranged at predetermined locations therealong, preselected ones of said outlets being provided with tubular means selectively positionable relative to an associated conduit for directing fluid in predetermined directions against the mixing components and interior wall faces of the container.

2. The apparatus of claim 1 wherein said conduits include reaches disposed at least partially within the container.

3. The apparatus of claim 2 wherein said reaches define a peripheral loop interiorly of the container.

4. The apparatus of claim 1 wherein said fluid is a liquid, and wherein reservoir means are provided for storing said liquid, said pump means being pneumatically driven and coupled to a compressed air source.

5. The apparatus of claim 4 further including timer means interposed between said pump means and said air source operable for selectively actuating said pump means.

6. A method for supplying fluid to a material mixing container having side walls, an open top, a bottom portion provided with a dump gate and internal mixing components including a blade mounted on a power-driven rotatable shaft for purposes of washing and mixing comprising:

introducing a predetermined amount of fluid into the container for direction against the internal mixing components and interior wall faces of the container for purposes of washing;

retaining a predetermined amount of said introduced fluid within the container; and adding a predetermined amount of additional fluid until a preselected total amount of fluid is contained within the container.

7. The method of claim 6 wherein said fluid introducing step includes spraying fluid under pressure.

8. The method of claim 7 wherein said fluid spraying step is accompanied by operation of the internal mixing components.

* * * * *